US008616135B2

(12) United States Patent
Clark

(10) Patent No.: US 8,616,135 B2
(45) Date of Patent: Dec. 31, 2013

(54) TRANSIT VEHICLE FOR FERRYING ROADWAY VEHICLES, PASSENGERS, CARGO AND COMMUTERS

(76) Inventor: Don Clark, Mesquite, TX (US)

( * ) Notice: Subject to any disclaimer, the term of this patent is extended or adjusted under 35 U.S.C. 154(b) by 179 days.

(21) Appl. No.: 13/336,969

(22) Filed: Dec. 23, 2011

(65) Prior Publication Data

US 2013/0160671 A1 Jun. 27, 2013

(51) Int. Cl.
*B60N 5/00* (2006.01)

(52) U.S. Cl.
USPC ..... 105/329.1; 105/378

(58) Field of Classification Search
USPC ..... 105/329.1, 339, 337, 338, 333, 332, 105/331, 330, 341; 410/26, 27, 28, 28.1
See application file for complete search history.

(56) References Cited

U.S. PATENT DOCUMENTS

| | | | | |
|---|---|---|---|---|
| 4,913,061 | A * | 4/1990 | Youngblood | 105/378 |
| 5,765,486 | A * | 6/1998 | Black et al. | 105/410 |
| 6,283,040 | B1 * | 9/2001 | Lewin | 105/404 |
| 6,551,039 | B1 * | 4/2003 | Forbes | 410/26 |
| 6,821,065 | B2 * | 11/2004 | Forbes | 410/26 |
| 6,845,722 | B2 * | 1/2005 | Forbes | 105/355 |
| 7,784,150 | B2 * | 8/2010 | Anderson et al. | 16/2.1 |
| 8,267,626 | B2 * | 9/2012 | Claas et al. | 410/1 |
| 8,302,538 | B2 * | 11/2012 | Cencer et al. | 105/355 |
| 2002/0035948 | A1 * | 3/2002 | Schorr et al. | 105/404 |
| 2005/0074314 | A1 * | 4/2005 | Hart et al. | 414/234 |
| 2010/0104392 | A1 * | 4/2010 | Bowen et al. | 410/26 |
| 2012/0061338 | A1 * | 3/2012 | Willick et al. | 211/59.2 |
| 2013/0160671 | A1 * | 6/2013 | Clark | 105/329.1 |

* cited by examiner

*Primary Examiner* — Jason C Smith
(74) *Attorney, Agent, or Firm* — Wilson Daniel Swayze, Jr.

(57) ABSTRACT

A transit vehicle for use in the transporting of roadway vehicles whose passengers and cargo remain inside the roadway vehicle during transit, and the transporting of roadway vehicles whose passengers travel in a separate passenger area. The transit vehicle is essentially an overland ferry wherein drivers park their roadway vehicles in easy-access bays and remain inside their vehicle during commuter journeys or take a place in the passenger area on longer journeys. With rapid loading and unloading functions, and capable of high speed when powered by an appropriate motive source, the transit vehicle can reduce traffic congestion and vehicle emissions by transporting a substantial number of commuters.

4 Claims, 8 Drawing Sheets

TRANSIT VEHICLE FOR FERRYING ROADWAY VEHICLES, PASSENGERS, CARGO AND COMMUTERS

CROSS-REFERENCE TO RELATED APPLICATIONS

None.

FEDERALLY SPONSORED RESEARCH

Not applicable.

SEQUENCE LISTING OR PROGRAM

Not applicable.

BACKGROUND

1. Field

This application refers to a transit vehicle, more particularly to a ferry-like vehicle capable of transporting a plurality of roadway vehicles with their passengers and cargo.

2. Background

Virtually all sizeable cities in the world face enormously expensive challenges in managing automobile traffic. Cities have invested many billions of dollars in efforts to manage automobile traffic, reduce traffic congestion and improve air quality. These investments have funded transit systems such as bus, light rail and commuter rail, subway, trolleys, vanpools and carpool lanes. Despite massive investments, traffic congestion and air pollution continue to grow.

The Texas Transportation Institute, widely accepted as an authority on U.S. traffic data and trends, reports in their 2009 Urban Mobility Report that traffic congestion has increased in every category of city (very large, large, medium and small) as measured by "Delay Hours" between 1982 and 2007. Very large cities have increased from 21 hours of delay per driver per year to 51 hours per driver per year, an increase of 143 percent. For large cities the increase is 218 percent, for medium cities the increase is 188 percent and for small cities the increase is 217 percent.

The CIA World Factbook of 2006 reports that the U.S. and world populations are expected to continue growing into the foreseeable future. Growth is slowing from a high of 2.2 percent in the 1960's to 1.1 percent today. The rate of growth is expected to decline further but absolute numbers of people are forecast to increase until at least mid-century when the world population reaches approximately 9.2 billion.

The current U.S. nationwide adoption rate for public transportation is 4.9 percent (2008 ACS survey by the US Census Bureau). In numerical terms, 6.8 million out of 136 million commuters utilize public transportation. Public transit use is heavily skewed toward 1.) individuals without automobiles, and 2.) commuters in cities with robust subway systems, mostly along the east coast. Many sprawling western cities have public transit adoption rates of less than two percent.

At the same time, a recent Pew survey shows that fewer Americans like to drive. Many people, 31 percent, called driving a "chore". The reason they felt this way is "the growing hassle of traffic congestion" (23 percent), "other drivers" (14 percent) and "the grind of commuting to work" (10 percent). Other factors such as "waste of time" (5 percent), "tiring" (4 percent) and "stressful" (3 percent) add up to a large body of people who would rather not drive.

The two primary reasons that motivate commuters to choose automobiles over mass transportation are: 1.) mobility—automobiles provide commuters a high degree of mobility where public transportation systems inhibit mobility, especially in large, sprawling cities, and 2.) time—end-to-end commutes on public transportation systems generally require more time because the journey includes a.) walking, biking or driving from the start location to the transit system embarkation point, b.) the journey on the transit system that might involve several stops, connections and/or modal changes, and c.) walking or biking to the end location. Current public transportation systems do not meet the mobility requirement or time efficiency demanded by commuters.

The costs associated with traffic congestion are staggering. From the perspective of commuters there are statistical data indicating significant costs in wasted time, wasted fuel, lost productivity and increased stress and anxiety. From the perspective of city, county, state and federal governments there are well documented costs of managing and maintaining existing roadways and transit systems, plus construction of new roadways and transit systems. These circumstances create significant demand for traffic abatement projects that reduce traffic congestion, air pollution, and the hefty ongoing socioeconomic costs associated with crowded roadways.

Prior art is extensive and varied as it pertains to public transit systems. Some transit system designs are all-encompassing mobility systems in which private automobiles have no role. Other designs require various types of guide ways through which various specialized vehicles travel. Some designs attempt to transport modified automobiles and their passengers via overhead rails while others require highly specialized vehicles. A few systems transport unmodified roadway vehicles and their passengers but are very clearly designed for long distance rather than intra-city commuter travel. Prior art includes:

1. Closed loop systems represented by U.S. Pat. No. 3,403,634 to Crowder, U.S. Pat. No. 3,903,807 to Lee, U.S. Pat. No. 4,841,871 to Leibowitz, U.S. Pat. No. 5,016,542 to Mitchell, U.S. Pat. No. 5,797,330 to Li, and U.S. Pat. No. 6,810,817 to James. These systems share the objective of replacing automobiles with an all-encompassing urban transportation system. To utilize these systems commuters must leave their car behind and thereby forfeit mobility. Over the decades, commuters have shown consistently that they need and/or desire access to their automobiles at all times. Evidence of this is clear in the weak adoption rate of current transit systems. Closed loop systems suffer the burden of changing the behavior of urban commuters who cannot or will not abandon their automobiles during their daily commute.
2. Guideway systems represented by U.S. Pat. No. 5,063,857 to Kissel, Jr., U.S. Pat. No. 5,590,604 to Lund, U.S. Pat. No. 5,619,930 to Alimanestiano, U.S. Pat. No. 6,039,135 to Henderson, U.S. Pat. No. 6,182,577 to Billings, U.S. Pat. No. 6,202,566 to Hutchinson, U.S. Pat. No. 6,237,500 to Lund, U.S. Pat. No. 6,357,358 to Henderson, U.S. Pat. No. 6,353,857 to Kauffman, U.S. Pat. No. 6,668,729 to Richards, U.S. Pat. No. 6,721,985 to McCrary, and U.S. Pat. No. 6,923,124 to Roane. Widely varied, these systems utilize a variety of elaborate guide way designs to transport people and cargo (which can include automobiles) between points in the system. Some of the systems require highly specialized automobiles while others transport standard automobiles on pallet-like mechanisms. Disadvantages of these systems include: 1.) significant complexity, 2.) the requirement that commuters drive highly specialized automobiles designed specifically for the transit system (where applicable), and 3.) capacity is constrained in that the systems cannot accommodate hundreds of thousands of automobiles in a short period of rush hour traffic.

3. Monorail systems represented by U.S. Pat. No. 3,345,951 to Rethorst, U.S. Pat. No. 5,592,883 to Andress, III, and the TransDrive Transportation System. Similar to a monorail in principle, these systems transport modified automobiles between terminals utilizing a network of overhead rails. Automobiles must be fitted with external hardware mechanisms to which the monorail system attaches during transport. Disadvantages of these systems include: 1.) significant complexity, 2.) automobiles are not engineered in a manner that provides enough structural support to suspend the automobile by the roof, 3.) widely available evidence makes clear that drivers are highly selective about the design, features and performance of their automobiles and are unlikely to accept a costly and unsightly modification, and 4.) the capacity of these transit systems is limited by the speed at which automobiles can travel single-file while hanging from a monorail.
4. Automobile carriers represented by U.S. patent application Ser. No. 10/911,556 to Suematsu (of Japan), U.S. patent application Ser. No. 12/660,133 to Rigo (of Canada), U.S. Pat. No. 3,149,583 to Morrill and Republique Francaise brevet d'invention 1.274.220 to de Colnet. These systems transport both the passenger and automobile, albeit in separate transit vehicles. These systems share the disadvantage of a slow process for loading and unloading as commuters leave their automobile in a designated area and find their way to the passenger car while an employee of the transit system retrieves their car and loads it into the automobile carrier. Unloading of the vehicles and delivery to the passenger involves the same inherent delays. This category of transit system is not suited for the rapid pace of urban rush hour traffic involving hundreds of thousands of automobiles.
5. Automobile carriers with passengers in the same transit vehicle represented by U.S. Pat. No. 2,211,469 to King, U.S. Pat. No. 3,503,340 to Warren, U.S. Pat. No. 3,584,584 to Milenkovic, U.S. Pat. No. 3,892,188 to Warren, U.S. Pat. No. 4,397,496 to Drygas, and U.S. Pat. No. 7,275,901 to Carroll. These systems share the disadvantage of a very slow loading and unloading process as commuters leave their automobile in a designated area and find their way to the passenger cabin while an employee of the transit system retrieves their car and loads it into the automobile carrier portion of the transit vehicle. Unloading of the automobiles and delivery to the passenger involves the same inherent delays. This category of transit system is not suited for the rapid pace of urban rush hour traffic involving hundreds of thousands of automobiles.
6. U.S. Pat. No. 3,285,194 to Clejan. The Clejan transit system has several disadvantages which include: 1.) passengers exit their automobile and go to a lounge area elsewhere in the transit vehicle, 2.) automobile tires must be aligned with wheel guides mounted on the floor of the transit vehicle in order to precisely position the automobile in the transit vehicle, 3.) parking channels are very narrow, 4.) passengers may enter and exit their automobile through the driver side only, 5.) security of passengers and their property is compromised by the interconnected parking bays, 6.) adjacent automobiles are parked facing opposite directions, passenger side to passenger side, so that every other automobile is parked facing one direction while alternate automobiles face the other direction, a dangerous circumstance that requires crossing of oncoming traffic during entry and exit, and 7.) wide rollup bay doors operate slowly. The Clejan transit system is designed for intercity travel as evidenced by statements such as "it is contemplated that the system will serve two or more metropolitan areas, and that the two toll plazas mentioned will be arranged outside of the two respectively adjacent metropolitan areas and respectively connected thereto by highways". The Clejan transit system is not suited for the rapid pace of urban rush hour traffic involving hundreds of thousands of automobiles.
7. U.S. Pat. No. 3,357,712 to Milenkovic. The Milenkovic transit system has several disadvantages which include: 1.) passengers exit their automobile and go to the lounge area elsewhere in the transit vehicle, 2.) automobile tires must be aligned with wheel guides mounted on the floor of the transit vehicle in order to precisely position the automobile in the transit vehicle, 3.) narrow parking channels allow passengers entry/exit via one side of the vehicle only, 4.) security of passengers and their property is compromised by the interconnected parking bays, and 5.) standard gauge railroad tracks almost certainly will not provide adequate stability for a transit vehicle of the described height and width traveling at speeds of 200 MPH. The Milenkovic transit system is designed for intercity travel, as opposed to the present application which serves primarily urban commuter travel, as evidenced by its reference to the Clejan system (above, U.S. Pat. No. 3,285,194) with statements such as "As illustrated therein, the railway train serves two or more metropolitan areas, and two toll plazas will be arranged outside of the two respectively adjacent metropolitan areas and respectively connected thereto by highways". The Milenkovic transit system is not suited for the rapid pace of urban rush hour traffic involving hundreds of thousands of automobiles.
8. U.S. Pat. No. 3,785,514 to Forsyth et al., U.S. Pat. No. 3,896,946 to Forsyth et al., and U.S. Pat. No. 3,933,258 to Forsyth et al. The Forsyth transit systems are compatible only with small, highly specialized automobiles. Widely available evidence makes clear that drivers are highly selective about the design, features and performance of their automobiles and are unlikely to abandon their preferences. To utilize a transit system in this category while retaining their preferred automobile, a commuter must purchase an additional, highly specialized automobile. The new automobile represents significant expenses for purchase, maintenance, licensing and insurance, plus additional space in the garage or driveway. Where the family includes two commuters, a common circumstance, the financial burden is doubled. For these reasons the Forsyth transit systems are unlikely to meet with wide acceptance.
9. U.S. patent application Ser. No. 12/251,199 to Farooq. The Farooq transit system has several disadvantages: 1.) time delay as each transit vehicle is separated and spaced apart from other transit vehicles for loading and unloading, 2.) time delay as highly specialized tractor-trailer rigs are driven into place at either end of each transit vehicle to precisely position the loading/unloading ramps, 3.) time delay as automobiles carefully negotiate the tightly curving, sloping ramps to load and unload in single-file, 4.) assistance may be required by transit system staff to ensure that automobiles are parked closely enough together to permit a full complement of automobiles on each loading deck, and 5.) security of passengers and their property is compromised by the interconnected parking bays. Additionally, Farooq vaguely mentions and illustrates an embodiment of his transit system in which automobiles are transported transversely to the longitudinal direction of the transit vehicle but provides too little information to consider that concept a well formed embodiment. For example, no mention is made of how vehicles enter or exit the boxcars or whether passengers remain inside the vehicles. Farooq describes that his system can transport 200 commuter vehicles per train and that, with a 15-minute turnaround time, four trains can run per hour transporting a total of 800 commuter vehicles per hour. During a four-hour morning rush period (and same during the evening rush) his system can move a total of 3,200 commuter vehicles. This capacity is clearly inadequate for accommodating the rapid pace of urban rush hour traffic involving hundreds of thousands of automobiles.

SUMMARY

A transit vehicle for the transporting of roadway vehicles, may include:

a. an elongated longitudinally extending chassis, b. a housing being carried by said chassis and having a substantially box-like configuration including a substantially horizontal floor and a generally horizontal roof and a pair of upstanding end walls joining said floor and said roof, c. the floor being adapted to store thereupon a plurality of roadway vehicles extending substantially traversely with respect to the direction of travel of the transit vehicle and disposed in side-by-side relation with each other, d. a plurality of longitudinally spaced-apart bay dividers extending substantially traversely with respect to the direction of travel of the transit vehicle and extending the width of said floor and extending between said floor and said roof creating a plurality of laterally aligned bays whereby roadway vehicles may be driven onto or off of said floor between the bay dividers, e. a plurality of bay doors on opposing sides of the housing respectively associated with said bays and selectively moveable between an open and closed position, f. a motor for moving said doors between their open and closed positions.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

First Embodiment

Figure 1:
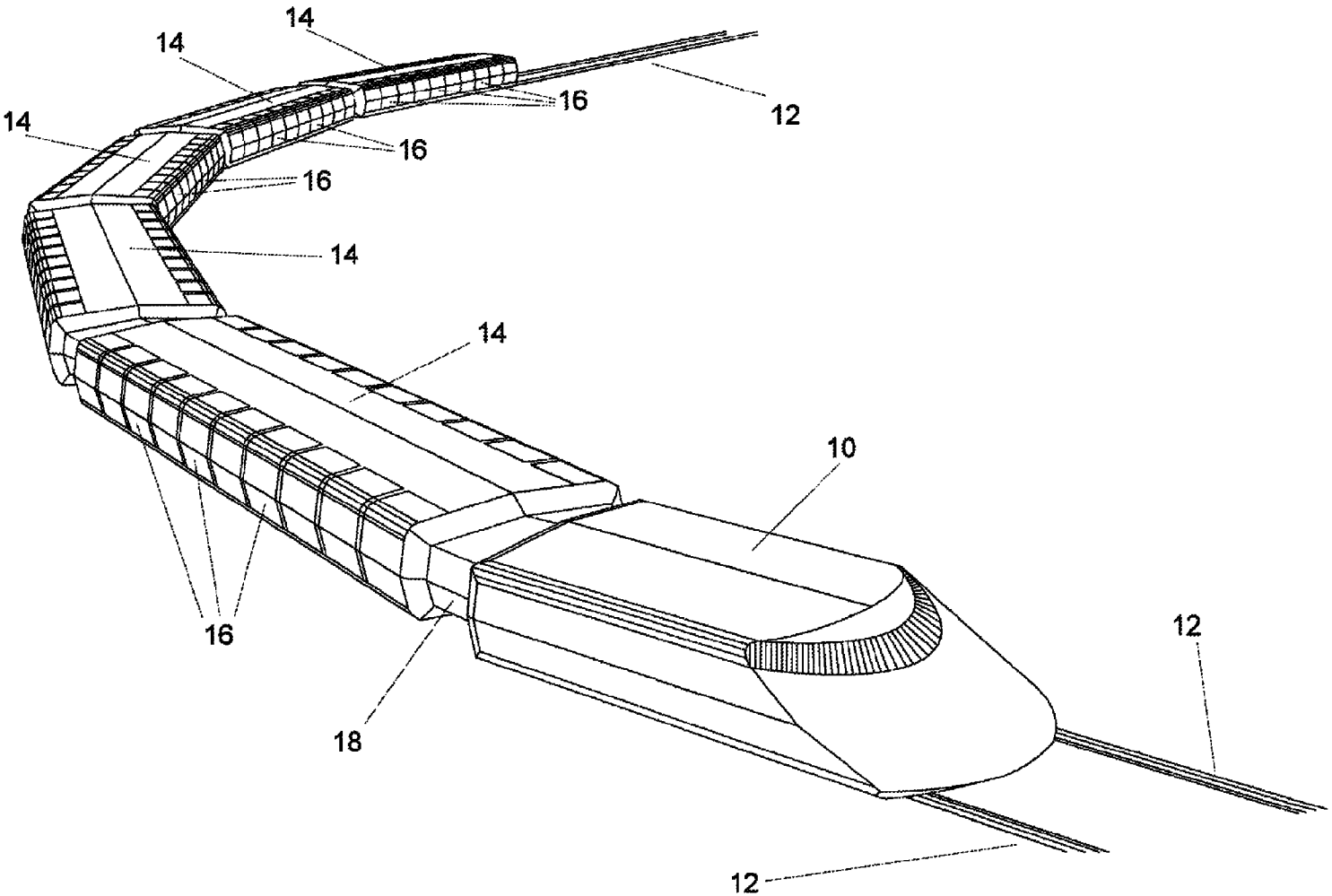
FIG. 1 is a perspective view of one embodiment of the transit vehicle configured as a train of five transit vehicles and a motive source that travels on ground-level rails.

In accordance with one embodiment a transit vehicle is designed to a.) facilitate the simple and rapid loading onto the transit vehicle of a plurality of roadway vehicles by the drivers of the roadway vehicles via a plurality of laterally aligned doorways, b.) provide secure and rapid travel to a destination while drivers and passengers remain within their roadway vehicle, and 3.) facilitate simple and rapid unloading from the transit vehicle of the roadway vehicles by the drivers of the roadway vehicles. The transit vehicle may be joined to a plurality of other transit vehicles and motive source to form a train that is configured to travel on rails below or above the transit vehicle, or on roadways or waterways.

DRAWINGS

Reference Numerals

Figure 3:
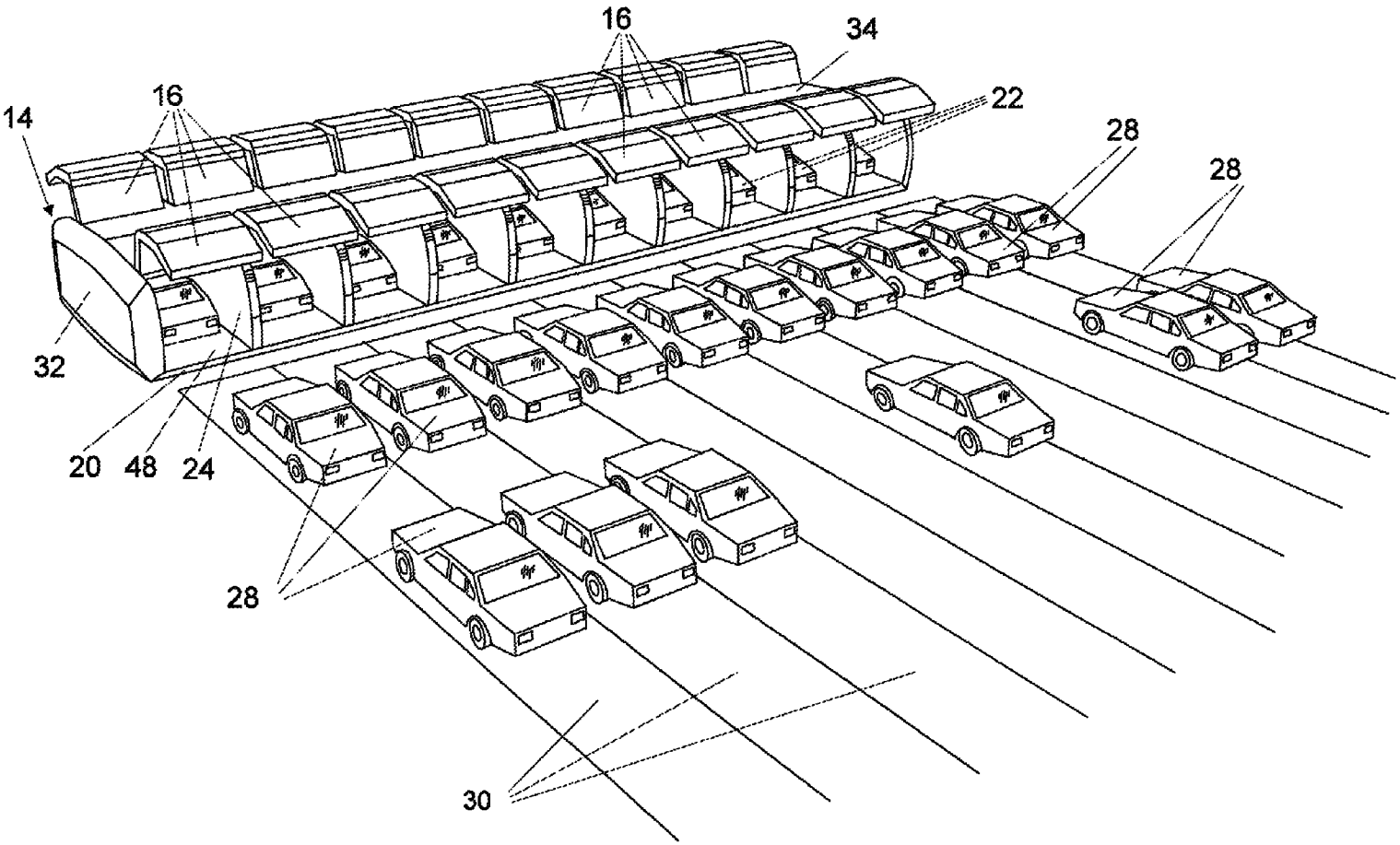
FIG. 3 is a perspective view of one embodiment of a single transit vehicle with doors open and roadway vehicles onboard while additional roadway vehicles queue in approach lanes.

10 Locomotive
12 Rails
13 Bogeys
14 Transit vehicle
16 Bay door
18 Connector
20 Parking bay
22 Roadway vehicle in bay
24 Bay divider
28 Roadway vehicle waiting
30 Approach lanes
32 End cap
34 Roof
36 Loading side of transit vehicle
38 Unloading side of transit vehicle
40 Bay door hinge
42 Access Door
44 Passenger seating, facilities and concession area
46 Chassis
48 Bay floor As illustrated in FIG. 3 (perspective, loading), transit vehicle 14 may include a housing of a box like configuration that may include a substantially horizontal floor 48 with dimensions appropriate to accommodate a plurality of roadway vehicles 22 parked substantially transversely to the direction of travel of the transit vehicle. A plurality of such floors 48, each a predetermined distance above the floor below, may be configured to accommodate additional roadway vehicles 22. Upstanding end walls 32 and bay dividers 24 may provide support to the roof 34 which substantially opposes the floor 48. The two longer sides of the transit vehicle which may extend between the roof 34 and the floor 48 and may extend between the end walls 32 may have an aperture appropriately sized and positioned to accommodate the entry and exit of roadway vehicles 22 into parking bays 20. Each aperture may cooperate with an associated door 16 on either side of the transit vehicle 22 with a motor (not shown) for moving the doors 16 between their open and closed positions. When the doors 16 are closed, the parking bay 20 may be substantially enclosed and substantially sealed.

Figure 6A:
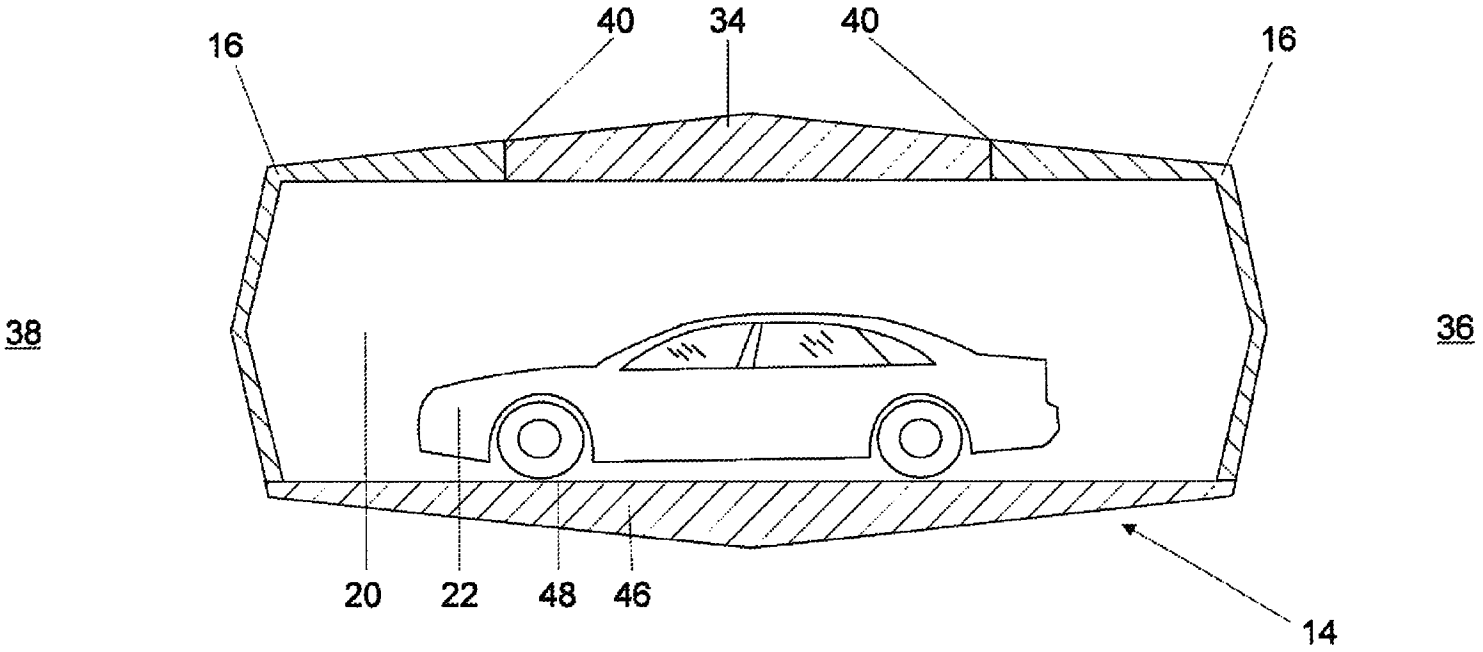
FIG. 6A is an end sectional view of one embodiment of the transit vehicle with bay doors closed and a roadway vehicle onboard.

As illustrated in FIG. 6A (end view, doors closed), transit vehicle 14 may include structural components in the chassis 46 and roof 34 to provide support to transit vehicle 14 and may accommodate the attachment of bay doors 16, wheels and/or other mobility devices, and such other devices as necessary to join transit vehicle 14 to other transit vehicles 14 and to a source of motive power. Structural components may vary depending on mode of travel (rail, roadway, or waterway) and whether the vehicle is positioned above the mode or suspended below the mode.

Referring again to FIG. 3 (perspective, loading), transit vehicle 14 may include a plurality of laterally aligned pairs of bay doors 16 on opposing sides of the deck floor 48 which may be sized appropriately to accommodate the passage of roadway vehicles 22, whereby roadway vehicles 22 may be driven forward onto and forward off of the deck floor 48 without reversing. Parking bay doors 16 may be of the gull wing (shown), swinging, sliding, roll-up, drawbridge or other design as suits the circumstances of the deployment environment. Each parking bay 20 for roadway vehicles 22 may be separated from other parking bays 20 by bay dividers 24 which may extend from the deck floor 48 to the roof 34 in the substantial horizontal direction and deck floors 48 in the substantial vertical direction so that each parking bay 20 is private and secure. Parking bays 20 may be adequately ventilated to expel exhaust gases from roadway vehicles 22 that may be left running during transit.

Figure 2:
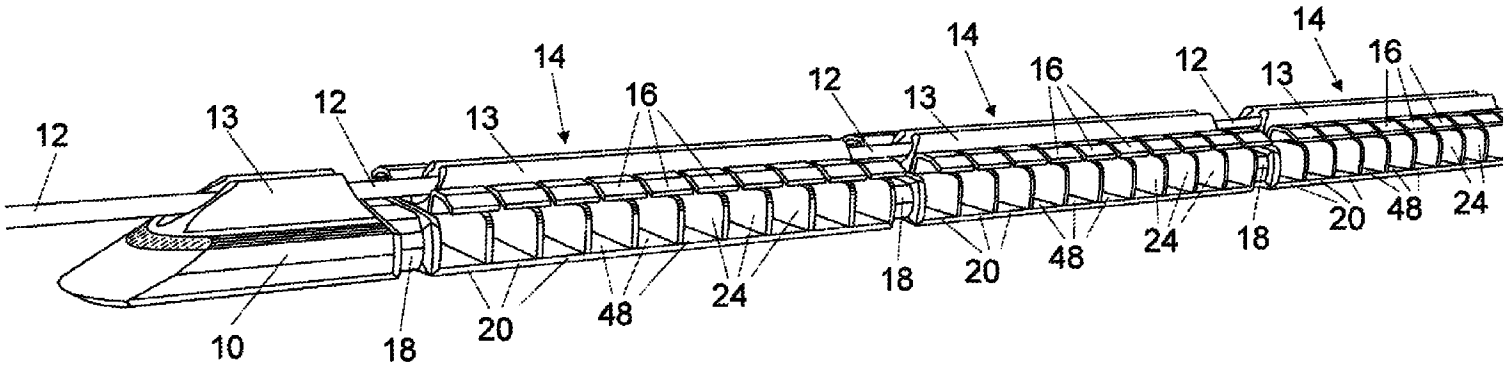
FIG. 2 is a perspective view of one embodiment of the transit vehicle configured as a train that travels on overhead rails with doors open as if ready to load and unload roadway vehicles.
Figure 4A:
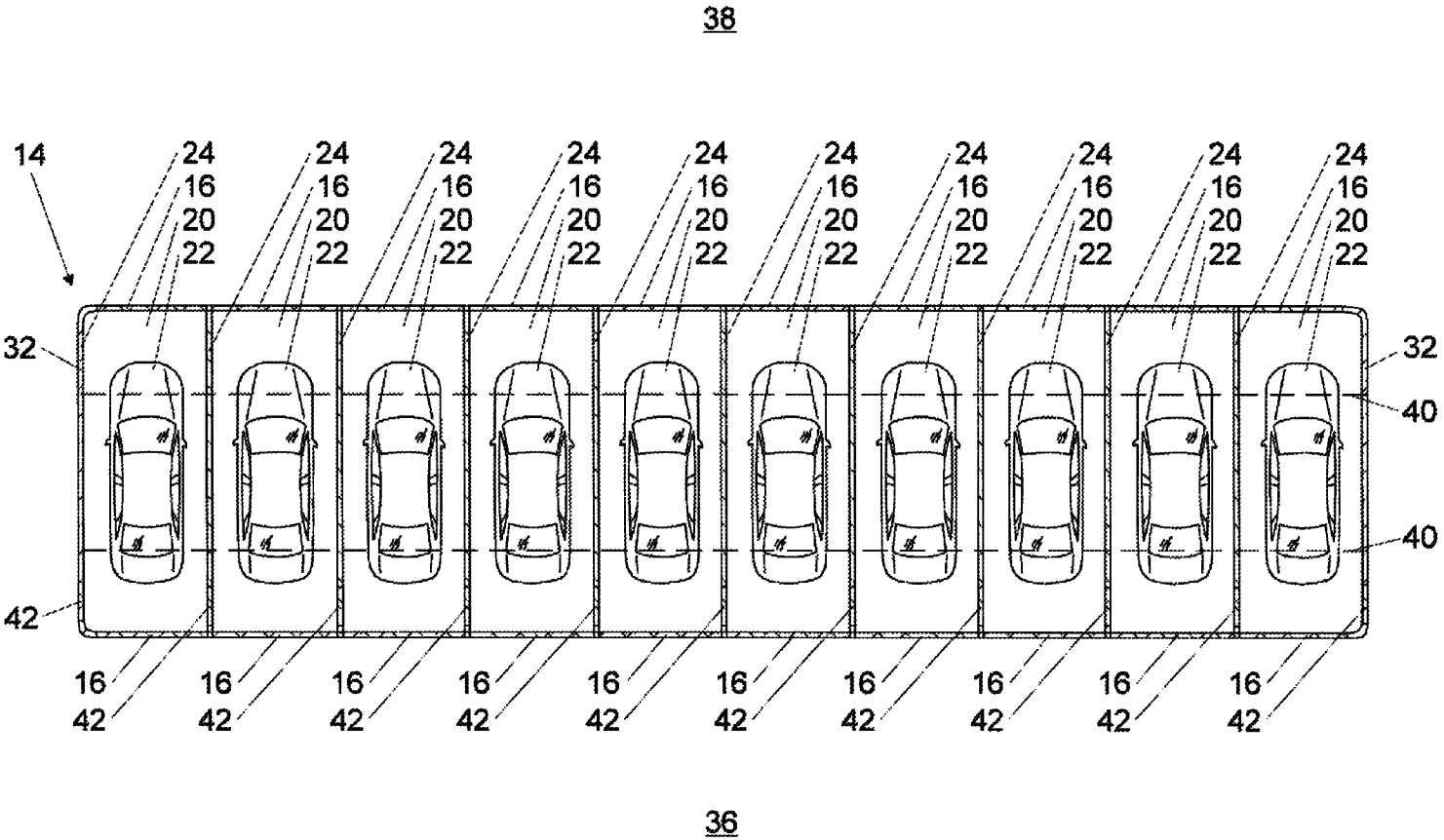
FIG. 4A is a top sectional view of one embodiment of the transit vehicle configured with an arbitrary number of parking bays with roadway vehicles loaded in each bay.

As illustrated in FIG. 2 (perspective, bay doors open), transit vehicle 14 may be suspended below overhead rails 12 or, as illustrated in FIG. 1 (perspective, in motion) the transit vehicle 14 may be equipped to ride on ground rails 12. In other configurations, not illustrated, transit vehicle 14 may be configured to travel on roadways or waterways. In all configurations, transit vehicle 14 may be configured to travel at grade level, overhead or underground to suit the circumstances of the deployment environment. As illustrated in FIG. 1 (perspective, in motion), a plurality of transit vehicles 14 may be joined together by connectors 18 and to a source of motive power 10 to form a train. A train segment is also illustrated in FIG. 2 (perspective, bay doors open) where a plurality of transit vehicles 14 may be joined together by connectors 18 and to a source of motive power 10. As illustrated in FIG. 4A (top sectional view) transit vehicle 14 may include several safety and security features. Bay dividers 24 may provide security by isolating each parking bay 20 from other parking bays, and access doors 42, here shown installed in bay dividers 24 but in other deployments might be installed within bay doors 16, provide means of escape in the event of an emergency.

Operation

First Embodiment

It is an object of the present embodiment to provide a transit vehicle useful as a carrier for roadway vehicles driven by commuters in the deployment area. Acceptable roadway vehicles in the U.S. may include all makes and models of light cars and trucks, SUVs, vans, motorcycles, bicycles, and other roadway vehicles within the general size and weight range of these vehicles. Drivers, passengers and cargo may remain in the roadway vehicle during transit.

In operation, as illustrated in FIG. 3 (perspective, loading), bay doors 16 open on both sides of transit vehicle 14 allowing onboard roadway vehicles 22 to exit by driving forward out of parking bay 20 while other roadway vehicles 28 queued in approach lanes 30 drive forward into parking bay 20. The deck floors 48 in the transit vehicle 14 may be constructed at substantially the same horizontal plane as approach lanes 30 and in close enough proximity that additional loading ramps are unnecessary. Queued roadway vehicles 28 drive into a parking bay 20 as easily as humans step into a subway train or elevator. Once transit vehicle 14 is loaded with roadway vehicles 22, bay doors 16 are closed and transit vehicle 14 is ready for transport.

Figure 6B:
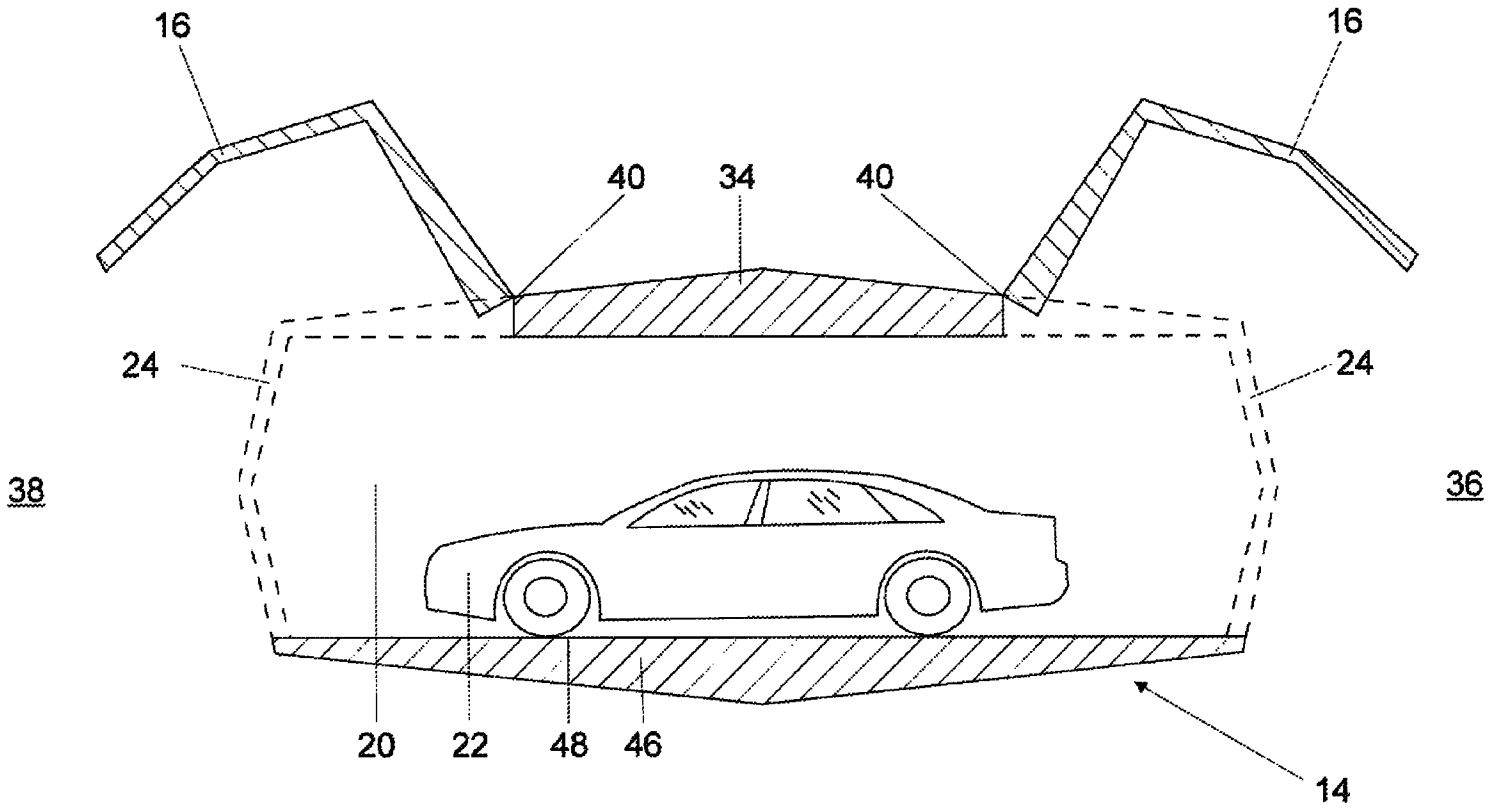
FIG. 6B is an end sectional view of one embodiment of the transit vehicle with bay doors open and a roadway vehicle onboard.

As illustrated in FIG. 4A (top sectional view), parking bays 20 are sized to accommodate roadway vehicles 22 without creating a challenging circumstance for the driver while entering or exiting transit vehicle 14. Roadway vehicles 22 nearly always enter transit vehicle 14 from the loading side of the transit vehicle 36 and nearly always exit transit vehicle 14 toward the unloading side of the transit vehicle 38. FIG. 6B further illustrates a roadway vehicle 22 in a parking bay 20 with the bay doors 16 open. Again, roadway vehicles 22 near always enter the transit vehicle 14 from the loading side of the transit vehicle 36 and near always exit the transit vehicle 14 toward the unloading side of the transit vehicle 38.

It is envisioned that terminals for transit systems based on this transit vehicle will be located at strategic points around the deployment area, ideally near major freeway intersections. Each terminal may have enough loading gates to accommodate area traffic. In the following non-limiting example, a train may include five transit vehicles, each with a capacity of 10 roadway vehicles each, is considered. Turnaround time to unload and reload the 50 roadway vehicles may be 60 seconds or less. In this scenario, a terminal with 10 loading gates can handle 500 arriving roadway vehicles and 500 departing roadway vehicles per minute, 30,000 roadway vehicles per hour in each direction. During a three-hour rush period, a single terminal can send and receive 90,000 roadway vehicles. Terminals will be located and scaled to meet expected traffic volumes.

In summary, this embodiment is designed and engineered to be quickly loaded with roadway vehicles, transported to a destination as rapidly as the motive source permits, and unloaded quickly. A typical stop may require as little as 30 seconds to unload and reload regardless of how many roadway vehicles each transit vehicle is configured to accommodate and how many transit vehicles are joined together to form a train. Rapid loading and unloading allows completion of many iterations of a journey during a given time period and thereby provides meaningful reduction of roadway traffic.

Second Embodiment

Figure 4B:
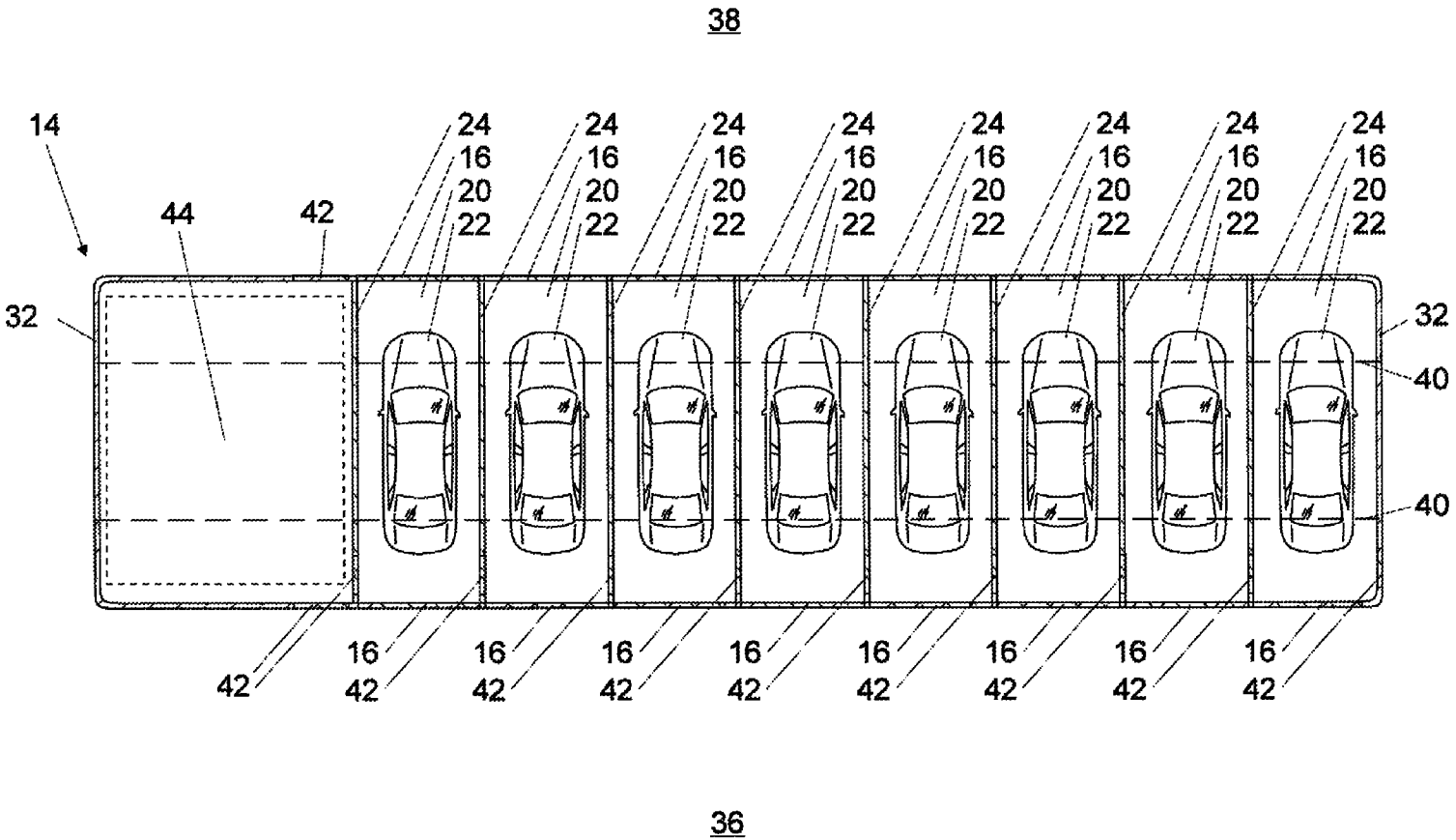
FIG. 4B is a top sectional view of one embodiment of the transit vehicle configured with a passenger area and an arbitrary number of parking bays with roadway vehicles loaded in each bay.
Figure 5A:
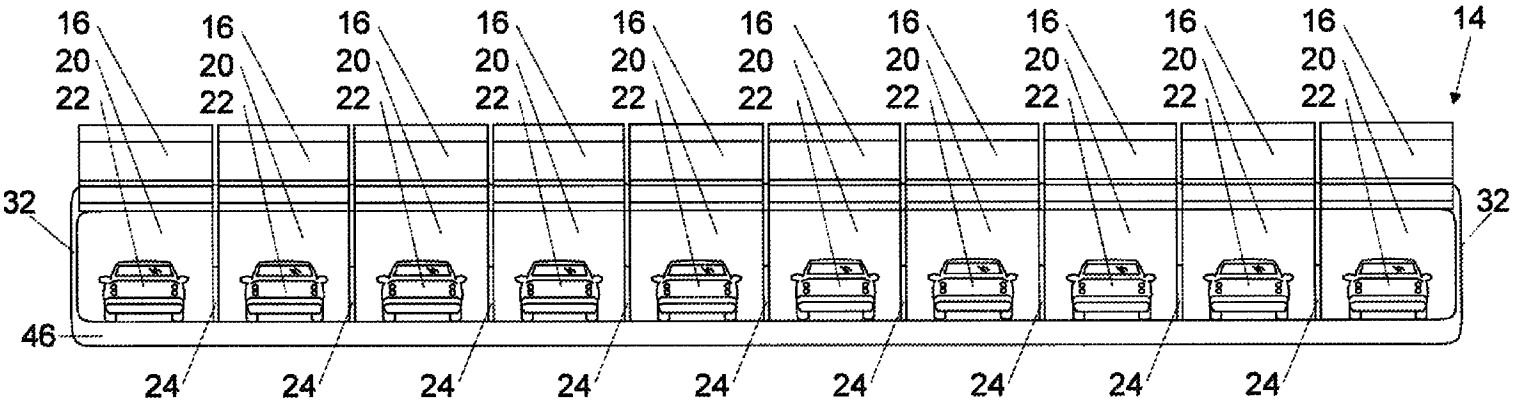
FIG. 5A is a side view of one embodiment of the transit vehicle configured with an arbitrary number of parking bays with bay doors open and roadway vehicles loaded in each bay.
Figure 5B:
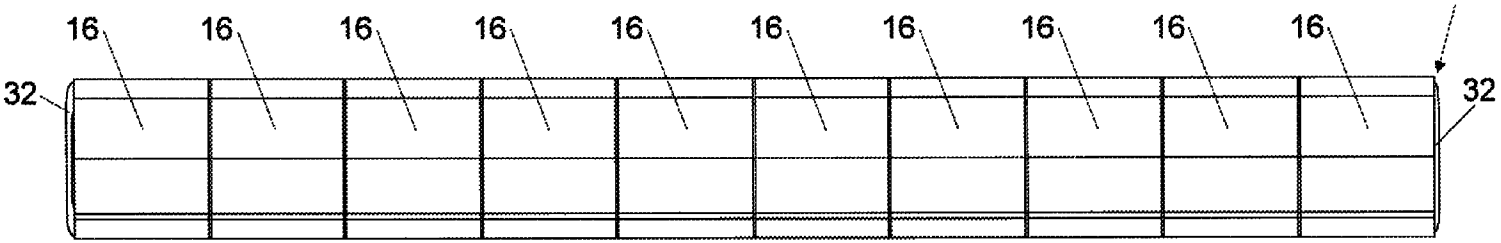
FIG. 5B is a side view of one embodiment of the transit vehicle configured with an arbitrary number of parking bays with bay doors closed.

As illustrated in FIG. 4B (top sectional view with passenger area) this embodiment is differentiated from the previous embodiment by the addition of a passenger area 44. Passenger area 44 may be isolated from parking bays 20 to accommodate commuters without vehicles or, on longer journeys, to accommodate drivers and passengers of roadway vehicles 22 in addition to commuters without vehicles. The passenger area 44 may include a combination of seating, concessions and facilities appropriate to the circumstances of deployment. Passenger area 44 will occupy more space where commuters without vehicles are frequent and where additional facilities are required for longer journeys.

As illustrated in FIG. 3 (perspective, loading), transit vehicle 14 may include a housing having a box-like configuration that has a substantially horizontal floor 48 with dimensions appropriate to accommodate a plurality of roadway vehicles 22 being loadable and parked substantially transversely to the direction of travel of the transit vehicle. A plurality of such floors 48, each an appropriate distance above the floor below, may be configured to accommodate additional roadway vehicles 22. Upstanding end walls 32 and bay dividers 24 may provide support to the roof 34 which may be opposed to the floor 48 and which is substantially the same size as the floor 48. The two longer an elongated sides of the transit vehicle may have apertures appropriately sized and positioned to accommodate the entry and exit of roadway vehicles 22 into parking bays 20. Each aperture may have an associated and opposed door on either side of the transit vehicle with a motor (not shown) for moving the doors between their open and closed positions. When the doors are closed, the parking bay may be substantially fully enclosed and sealed.

As illustrated in FIG. 6A (end view, doors closed), transit vehicle 14 may include structural components in the chassis 46 and roof 34 as necessary to provide support to transit vehicle 14 and to accommodate the attachment of bay doors 16, wheels and/or other mobility devices, and such other attachments and devices as necessary to join transit vehicle 14 to other transit vehicles 14 and to a source of motive power. Structural components may vary depending on mode of travel (rail, roadway, or waterway) and whether the vehicle is positioned above the mode or suspended below the mode.

Referring again to FIG. 3 (perspective, loading), transit vehicle 14 may include a plurality of laterally aligned pairs of bay doors 16 on opposed sides of the deck floor 48, sized appropriately to accommodate the passage of roadway vehicles 22, whereby roadway vehicles 22 may be driven forward onto and forward off of the deck floor 48. Parking bay doors 16 may be of the gull wing (shown), swinging, sliding, roll-up, drawbridge or other design as suits the circumstances of the deployment environment. Each parking bay 20 for roadway vehicles 22 may be separated from other parking bays 20 by extending between opposed bay dividers 24 in the substantial horizontal direction and extending between deck floors 48 in the substantial vertical direction so that each parking bay 20 is private and secure. Parking bays 20 may be adequately ventilated to expel exhaust gases from roadway vehicles 22 that may be left running during transit.

As illustrated in FIG. 2 (perspective, bay doors open), transit vehicle 14 may be suspended below overhead rails 12 or, as illustrated in FIG. 1 (perspective, in motion) the transit vehicle 14 may be equipped to ride on ground rails 12. In other configurations, not illustrated, transit vehicle 14 may be configured to travel on roadways or waterways. In all configurations, transit vehicle 14 may be configured to travel at grade level, overhead or underground in accordance with the circumstances of the deployment environment.

As illustrated in FIG. 1 (perspective, in motion), a plurality of transit vehicles 14 may be joined together by connectors 18 and connected to a source of motive power 10 to form a train. A train segment is also illustrated in FIG. 2 (perspective, bay doors open) where a plurality of transit vehicles 14 are joined together by connectors 18 and connected to a source of motive power 10.

As illustrated in FIG. 4A (top sectional view) transit vehicle 14 has several safety and security features. Bay dividers 24 provide security by substantially isolating each parking bay 20 from other parking bays 20, and access doors 42, here shown installed in bay dividers 24 but in other deployments might be installed within bay doors 16, provide means of escape in the event of an emergency.

Operation

Second Embodiment

It is an object of the present embodiment to provide a transit vehicle useful as a carrier for commuters and roadway vehicles driven by commuters in the deployment area. Acceptable roadway vehicles in the U.S. may include all makes and models of light cars and trucks, SUVs, vans, motorcycles, bicycles, and other roadway vehicles within the general size and weight range of these vehicles. Drivers, passengers and cargo may remain in the roadway vehicle during transit or, on longer journeys, may vacate to the passenger area of the transit vehicle.

In operation, as illustrated in FIG. 3 (perspective, loading), bay doors 16 open on both opposed sides of transit vehicle 14 allowing onboard roadway vehicles 22 to exit by driving forward out without reversing of parking bay 20 while other roadway vehicles 28 queued in approach lanes 30 drive forward into parking bay 20. It is anticipated that deck floors 48 in the transit vehicle 14 may be constructed at substantially the same horizontal plane as approach lanes 30 and in close enough proximity that additional loading ramps are unnecessary. Queued roadway vehicles 28 drive into a parking bay 20 as easily as humans step into a subway train or elevator. Once transit vehicle 14 is loaded with roadway vehicles 22 and passengers are positioned in passenger area 44, bay doors 16 are closed and transit vehicle 14 is ready for transport.

As illustrated in FIG. 4A (top sectional view), parking bays 20 may be sized to accommodate roadway vehicles 22 without creating a challenging circumstance for the driver while entering or exiting transit vehicle 14. Roadway vehicles 22 nearly always enter transit vehicle 14 from the loading side of the transit vehicle 36 and nearly always exit transit vehicle 14 toward the unloading side of the transit vehicle 38. FIG. 6B further illustrates a roadway vehicle 22 in a parking bay 20 with the bay doors 16 open. Again, roadway vehicles 22 nearly always enter the transit vehicle 14 from the loading side of the transit vehicle 36 and nearly always exit the transit vehicle 14 toward the unloading side of the transit vehicle 38.

It is envisioned that terminals for transit systems based on this transit vehicle will be located at strategic points around the deployment area, ideally near major freeway intersections. Each terminal will have enough loading gates to accommodate area traffic. In the following non-limiting example a train comprised of five transit vehicles, each with a capacity of 10 roadway vehicles each, is considered. Turnaround time to unload and reload the 50 roadway vehicles is 60 seconds. In this scenario, a terminal with 10 loading gates can handle 500 arriving roadway vehicles and 500 departing roadway vehicles per minute, 30,000 roadway vehicles per hour in each direction. During a three-hour rush period, a single terminal can send and receive 90,000 roadway vehicles. Terminals will be located and scaled to meet expected traffic volumes.

In summary, this embodiment is designed and engineered to be loaded quickly with commuters and roadway vehicles, transported to a destination as rapidly as the motive source permits, and unloaded quickly. A typical stop may require a very few minutes to unload and reload regardless of how many commuters and roadway vehicles each transit vehicle is configured to accommodate and how many transit vehicles are joined together to form a train. Rapid loading and unloading allows completion of many iterations of a journey during a given time period and thereby provides meaningful reduction of roadway traffic. The inclusion of a passenger area allows longer journeys and intersection with other transit systems.

ADVANTAGES

From the descriptions above, a number of advantages of some embodiments become evident:

(a) In one or more embodiments, the transit vehicle transports roadway vehicles to a destination while commuters and cargo remain inside the roadway vehicle. At the destination, the driver of the roadway vehicle simply drives his roadway vehicle out of the transit vehicle and continues on his journey. This feature satisfies the desire of commuters to retain possession of their roadway vehicle at all times.

(b) In one or more embodiments, the transit vehicle is designed to load and unload in a very rapid manner by the drivers of the roadway vehicles. Bay doors open on both sides of the transit vehicle so that exiting vehicles can drive forward out of the transit vehicle and entering roadway vehicles can drive in behind them, almost simultaneously. The process is as simple as driving into a garage with no need to precisely align the car with wheel guides or to negotiate inclined, curving ramps. Further, in one or more embodiments the transit vehicle is designed to travel as fast as the mode and motive power permit. Combined, these features satisfy the desire of commuters to arrive at their destination in a timely manner.

(c) In one or more embodiments, the transit vehicle is capable of transporting a wide variety of roadway vehicles. Acceptable vehicles in the U.S. include all makes and models of light cars and trucks, SUVs, vans, motorcycles, bicycles and foot traffic. This feature satisfies the desire of commuters to drive a roadway vehicle with design, features and performance of their own choosing.

(d) In one or more embodiments, the transit vehicle is designed with parking bays for roadway vehicles that are each separated from other parking bays by walls in the horizontal direction and floors in the vertical direction. This feature provides a safe and secure travel environment.

(e) In one or more embodiments, the transit vehicle can be configured to travel via rail, roadway, waterway or other mode as best befits the deployment environment. This feature provides flexibility to transit systems based on this transit vehicle.

(f) In one or more embodiments, the transit vehicle can intersect with other transit systems to create robust transportation capabilities. Buses, commuter rail, trolleys, subways and other forms of transit might bring commuters from distant neighborhoods to the station serving this transit vehicle for whisking to a distant terminal where local transit systems complete the journey. This feature adds value to existing community investments in public transportation.

(g) In one or more embodiments, it is envisioned that terminals for transit systems based on this transit vehicle will be located at strategic points around the deployment area. Each terminal will have a plurality of loading gates, similar to an airport, with each gate having a specific destination. Terminals and gates will be scaled to accommodate area traffic. In the following non-limiting example, a train comprised of five transit vehicles, each with a capacity of 10 roadway vehicles, is considered. Turnaround time to unload and reload the 50 roadway vehicles in this example is 60 seconds. In this scenario, a terminal with 10 loading gates can handle 500 arriving roadway vehicles and 500 departing roadway vehicles per minute, 30,000 roadway vehicles per hour in each direction. This single terminal can handle 90,000 arrivals and 90,000 departures of roadway vehicles during a three-hour rush period. This feature provides enough capacity to reduce traffic congestion and improve air quality in the deployment area.

CONCLUSION, RAMIFICATIONS AND SCOPE

Professor Rolf Pendall of Cornell University analyzed suburban sprawl over the course of the 1980s in 282 metropolitan areas and found that population growth explains about 31 percent of the growth in land area. He found that even those areas that experienced no population growth increased in urbanized land area by an average of 18 percent. Data collected by the U.S. Department of Housing and Urban Development for its State of the Cities 2000 report (1994-1997 time period) show that our urban areas continue to expand at about twice the rate that the population is growing. Larger urban areas mean longer daily commutes to work.

This transit vehicle provides a robust transportation solution by transporting commuters with or without roadway vehicles in a quick and efficient manner. Roadway vehicles and commuters are loaded quickly, transported as fast as the mode and motive power permit, and unloaded quickly at the destination. Commuters never leave their vehicle. It is envisioned that all journeys utilizing this transit vehicle will be point-to-point. In a well-designed system there will be little need to change trains.

During peak traffic hours, and even during non-peak hours, a transit system based on this transit vehicle can transport commuters and their roadway vehicles to a destination faster than it is possible to drive the roadway vehicle to the destination. This speed, combined with the convenience of retaining their roadway vehicle, provides great incentive for commuters to utilize a transit system based on this transit vehicle.

As further incentive to utilize a transit system based on this transit vehicle, a commuter utilizing the system will reduce driving miles and thereby reduce the cost of automobile fuel, insurance, tires, scheduled maintenance and repairs. Further, an individual might save significant money by retaining a roadway vehicle longer if it has low mileage. Even lessees will enjoy reduced lease rates due to lower miles.

With reduced traffic congestion, cleaner air and a convenient means of commuting across town quickly, municipalities with transit systems based on this transit vehicle will score higher in quality of life rankings.

This transit vehicle can be equipped with cellular receivers for telephone communications and wireless access points for computer connectivity. Video screens can be mounted on the wall ahead of the vehicle to display instructions, news, weather and advertising.

Other modes of public transit can make stops at terminals servicing this transit vehicle so that passengers can ride a bus ride or vanpool to this terminal, zip across town at high speed then connect with another bus or vanpool for the short trip to their workplace. Strategically, municipalities could re-deploy their bus fleets deeper into suburban neighborhoods since there will be less need for buses to travel long distances across town. With bus stops closer to home, suburban passengers might find the combination of bus and this transit vehicle an ideal commute solution.

Transit systems based on this transit vehicle can be implemented as an area-wide system or as a targeted point-to-point link. One area might opt for a wide scale solution with terminals in a dozen strategic locations while another area may opt for a point-to-point link between a city and a distant airport, stadium or sister city.

Although the descriptions above contain much specificity, these should not be construed as limiting the scope of the embodiments but as merely providing illustrations of some of the presently preferred embodiments. For example, the transit vehicle might be configured with 10 parking bays as illustrated in the drawings or with 15 or even 20 parking bays or more; or with parking bays designed specifically for motorcycles or compact cars; or in a double-decked or triple-decked layout; or with pontoons for water deployments.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A transit vehicle for the transporting of roadway vehicles, comprising:

g. an elongated longitudinally extending chassis, h. a housing being carried by said chassis and having a substantially box-like configuration including a substantially horizontal floor and a generally horizontal roof and a pair of upstanding end walls joining said floor and said roof, i. said floor being adapted to store thereupon a plurality of roadway vehicles extending substantially traversely with respect to the direction of travel of the transit vehicle and disposed in side-by-side relation with each other, j. a plurality of longitudinally spaced-apart bay dividers extending substantially traversely with respect to the direction of travel of the transit vehicle and extending the width of said floor and extending between said floor and said roof creating a plurality of laterally aligned bays whereby roadway vehicles may be driven onto or off of said floor between said bay dividers, k. a plurality of bay doors on opposing sides of said housing respectively associated with said bays and selectively moveable between an open and closed position, l. a motor for moving said doors between their open and closed positions.

2. The transit vehicle set forth in claim 1, wherein a. a passenger seating area being physically isolated with respect to said bays, and b. a plurality of doors for entry and exit from said passenger seating area.

3. The transit vehicle set forth in claim 1, wherein a. said housing includes a plurality of said floors, b. said floors being substantially identical to the main floor including said bay dividers and said bay doors and said motor for moving said bay doors between their open and closed positions, c. and said floors being spaced vertically to accommodate roadway vehicles and passengers.

4. The transit vehicle set forth in claim 3, wherein a. a passenger seating area being physically isolated of said bays, and b. a plurality of doors being provided for entry and exit from said passenger seating area.

* * * * *